United States Patent [19]

Driessen et al.

[11] 4,160,930

[45] Jul. 10, 1979

[54] ELECTRIC DISCHARGE LAMP WITH ANNULAR CURRENT CONDUCTOR

[75] Inventors: Antonius J. G. C. Driessen; Hendricus E. M. C. Vos, both of Eindhoven, Netherlands

[73] Assignee: U.S. Philips Corporation, New York, N.Y.

[21] Appl. No.: 723,743

[22] Filed: Sep. 16, 1976

[30] Foreign Application Priority Data

Sep. 29, 1975 [NL] Netherlands ..... 7511415

[51] Int. Cl.[2] ..... H01J 17/04; H01J 61/06

[52] U.S. Cl. ..... 313/217; 313/198; 313/331

[58] Field of Search ..... 313/331, 332, 334, 219, 313/217, 197, 198

[56] References Cited

U.S. PATENT DOCUMENTS

| | | | |
|---|---|---|---|
| 3,230,410 | 1/1966 | Hafkemeyer, Jr. | 313/197 |
| 3,832,589 | 8/1974 | Pfaue | 313/219 |
| 4,011,480 | 3/1977 | Jacobs et al. | 313/331 |
| 4,052,635 | 10/1977 | Jacobs | 313/331 |
| 4,052,636 | 10/1977 | Strok | 313/219 |

*Primary Examiner*—Saxfield Chatmon, Jr.
*Attorney, Agent, or Firm*—Thomas A. Briody; Robert S. Smith

[57] ABSTRACT

The current leadthrough for the auxiliary electrode of a discharge lamp with ceramic lamp vessel is constructed as a cylindrical tube concentric with the leadthrough of the main electrode. The cylindrical tube which serves as a current leadthrough can extend in the lamp vessel and serve itself as an auxiliary electrode. This construction avoids cracking of the lamp vessel. Niobium and tantalum, tungsten molybdenum, rhenium and alloys thereof may be used for the current leadthrough.

1 Claim, 4 Drawing Figures

ELECTRIC DISCHARGE LAMP WITH ANNULAR CURRENT CONDUCTOR

The invention relates to a discharge lamp having a cylindrical ceramic lamp vessel provided with end seals which mainly consist of ceramic and having incorporated in each of the seals a respective cylindrical current leadthrough for a main electrode and, in at least one of the seals, a current leadthrough for an auxiliary electrode.

In discharge lamps having a high operating temperature, for example 1000° C. or higher as is the case in high-pressure sodium and high-pressure mercury lamps, (the latter of which may contain in addition metal halides), the lamp vessel consists of a ceramic material which is to be understood to mean herein both polycrystalline material, for example translucent, gas-tight $Al_2O_3$, $MgAl_2O_4$ (spinel) and $Y_2O_3$, and also monocrystalline material, such as sapphire.

Since said material cannot be deformed at higher temperatures, ceramic discharge vessels are usually sealed with ceramic moulds while using shrink and sintering methods and/or while using sealing material.

Due to the large temperature differences to which a lamp vessel is subjected, great attention should be paid to the nature of the materials used as current leadthroughs for the electrodes. They preferably have a coefficient of thermal expansion which corresponds to that of the ceramic. Therefore, mainly niobium and tantalum are considered for use, metals which are not only expensive but, at higher temperatures cannot withstand halides or oxygen.

From German Patent application No. 1,471,379 laid open to public inspection a discharge lamp of the kind mentioned in the preamble is known. In this case, a solid niobium rod is incorporated in a bore in a ceramic end seal as a current leadthrough for a main electrode, while in a smaller eccentric bore in the end seal a tantalum wire is provided as a current leadthrough for an auxiliary electrode.

It has been found that in such a lamp cracking may occur near the leadthrough of the auxiliary electrode, possibly as a result of the fact that the coefficients of expansion of the materials used are not quite the same. This is the beginning of the end of the life of the lamp as a result of leakage of gas.

Cracking also occurs easily if the current leadthrough for an auxiliary electrode is provided in the cylindrical wall of the lamp vessel.

British patent specification No. 1,095,712 discloses a lamp construction in which a metal ring is incorporated between one end of the discharge envelope and the end seal, said ring projecting both inside and outside the lamp vessel. Within the lamp vessel a tungsten wire is welded to the ring, which wire extends to near the main electrode at the other end of the lamp vessel and serves as an auxiliary electrode.

The lamp exhibits a few drawbacks, such as the high heating of the auxiliary electrode during operation as a result of which the electrode is deformed and can get out of the proximity of the main electrode, and the shadow formation to which the auxiliary electrode gives rise. The major drawback, however, is the low mechanical rigidity of the construction and the complexity of the manufacture of the lamp.

The drawback of low rigidity also applies to the construction of the U.S. Pat. No. 3,461,334 in which a niobium or tantalum ring is incorporated as an auxiliary electrode between one end of the lamp vessel and a cylindrical ceramic elongation member thereof.

This drawback is confirmed in Dutch Patent application No. 7,304,860 laid open to public inspection, in which as an alternative for an auxiliary electrode formed by an internally metallized ceramic cylindrical member and a current leadthrough therefor in the form of a metallized end face of said cylindrical member, is mentioned the interposition of a solid metal ring between lamp vessel and cylindrical member.

The solution which is preferred according to said patent application in the form of a metallized cylindrical member of ceramic material, however, also has the drawback of a low mechanical rigidity, while in addition the distance between the auxiliary electrode and the main electrode is fully determined by the diameter of the lamp vessel the optimum value of which, however, is given by quantities other than a desired maximum main/auxiliary electrode spacing.

It is an object of the present invention to provide a lamp construction which is mechanically rigid, can easily be realized, in which the use of metals of low resistance, although applicable, can be avoided, and in which the life of the lamp is not shortened by the occurrence of cracking near the current leadthroughs.

This invention is inter alia based on the recognition of the fact that stress concentrations in the lamp vessel can be avoided by a rotationally symmetric geometry of the lamp vessel, its end seals and current leadthroughs.

Accordingly, the invention provides to an electric discharge lamp of the kind mentioned in the preamble wherein the current leadthrough for the auxiliary electrode is a cylindrical tube which surrounds the current leadthrough for the main electrode concentrically and is separated therefrom by a ceramic ring.

The current leadthrough for the auxiliary electrode projects both beyond the end seal of the lamp vessel—so as to enable the connection of an external current conductor—and in the lamp vessel to be secured, for example, to a wire-shaped auxiliary electrode.

A more simple embodiment includes an auxilliary electrode in the form of one or more strips forming one assembly with the current leadthroughs.

In a preferred embodiment the cylindrical tube of the current leadthrough projects at least 2 mm in the lamp vessel. The advantage of this is that the ceramic ring of the end seal between current leadthrough for the auxiliary electrode and current leadthrough for the main electrode, also upon extinguishing the lamp, is at such a temperature that no condensation of amalgam or halide takes place at that area, as a result of which short-circuit of main electrode and auxiliary electrode might otherwise take place. This measure consequently ensures a rapid ignition of the lamp.

However, a construction is preferred in which the cylindrical tube of the current leadthrough extends in the lamp over such a distance that the tube itself serves as an auxiliary electrode. The advantage of this construction is that the unit auxiliary electrode-current leadthrough can easily be manufactured.

Another advantage of the tubular auxiliary electrode is that material evaporated from the main electrode deposits on the wall of the tube so that blackening of the wall of the lamp vessel is prevented.

The auxiliary electrode may have such a length as to project further into the lamp vessel than the main electrode. As a result of this, however, the lateral light radiation may be impeded, so that an auxiliary electrode is to be preferred which does not project in front of the main electrode. The main electrode preferably projects slightly beyond a tubular auxiliary electrode, approximately by 1 mm, for example.

The tubular auxiliary electrode preferably surrounds the main electrode as closely as is possible by the technology of the production process of the lamp, while on the other hand the inside diameter of the tube is preferably not more than 4 mm larger than the largest diameter of the main electrode.

The outside diameter of the tubular auxiliary electrode is preferably so small that there exists a more than capillary space between the auxiliary electrode and the wall of the lamp vessel, this mainly to prevent said space from being filled with sealing material during the manufacture of the lamp.

The current leadthroughs—and, if the leadthrough for the auxiliary electrode forms one assembly with that electrode, also the auxiliary electrode itself— may consist of niobium or tantalum.

The current leadthrough for the main electrode may be a hollow cylinder or a solid cylinder.

According to the non-prepublished Netherlands patent application No. 7,414,846 (PHN.7806), tubular current leadthroughs consisting of tungsten, molybdenum, rhenium or alloys thereof, may alternatively be incorporated in the end seals of a ceramic lamp vessel. In that case a cylindrical ceramic moulding is provided in the current leadthrough at the area where said leadthrough is surrounded by the end seal of the lamp vessel.

Using the present invention, the current leadthrough for the auxiliary electrode in the lamps according to the present invention may consist of tungsten, molybdenum, rhenium or alloys thereof, since a cylindrical ceramic moulding is present within said current leadthrough at the area of the end seal of the lamp vessel.

In the lamp according to the invention, if a hollow cylinder is used as a current leadthrough for the main electrode, said leadthrough may consist of tungsten, molybdenum, rhenium or alloys thereof, provided a cylindrical ceramic moulding is provided therein.

The wall thickness of the current leadthrough for the auxiliary electrode when using tungsten, molybdenum, rhenium or alloys thereof as a rule is 20 to 250 μm, preferably 20 to 150 μm, and when using niobium or tantalum is preferably 100–300 μm.

It is to be noted that the use of the first-mentioned materials for the current leadthroughs presents the advantages of resistance against oxygen and halides and a lower cost-price.

In manufacturing the end seals of the lamp envelope, use may be made inter alia of the known sealing materials which can withstand fillings of discharge lamps, for example, those described in the U.S. Pat. Nos. 3,281,309, 3,441,421 and 3,588,277 and in the abovementioned patent publications.

For connecting a ceramic end seal mould to the cylindrical wall of the lamp vessel use may also be made of shrinkage-sintering methods, as described for example in U.S. Pat. No. 3,564,328.

The ceramic mouldings which are used for the manufacture of the end seals are proportioned so that the spaces between leadthroughs and ceramic mouldings and, if required, between moulding and cylindrical wall of the lamp vessel, is filled with filling material by capillary action.

Embodiments of the invention will now be described in greater detail by way of example with reference to the accompanying drawings, in which.

Figure 1:
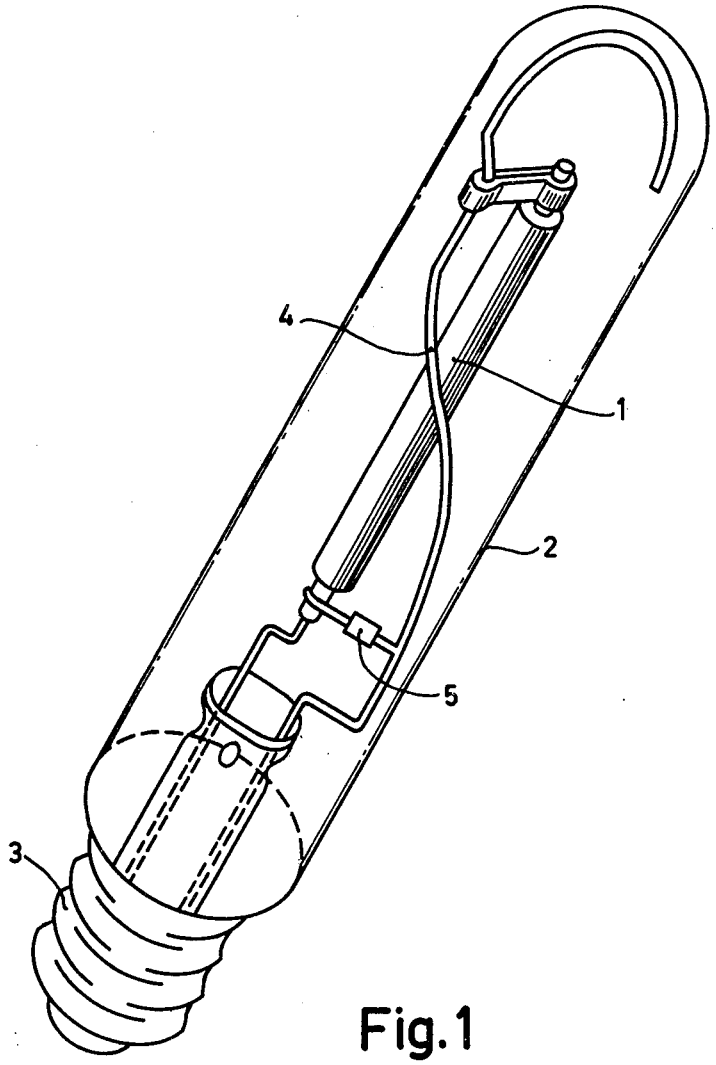
FIG. 1 is an elevation of a finished lamp.

Reference numeral 1 in FIG. 1 denotes the lamp vessel of a 220 V/250 W high pressure sodium discharge lamp which is incorporated in an outer envelope 2 which has a lamp cap 3. A pole wire 4 also serving to support the lamp vessel on the outer envelope supples current to one of the main electrodes and, via a resistor 5, also to the auxiliary electrode (13 in FIG 2).

Figure 2:
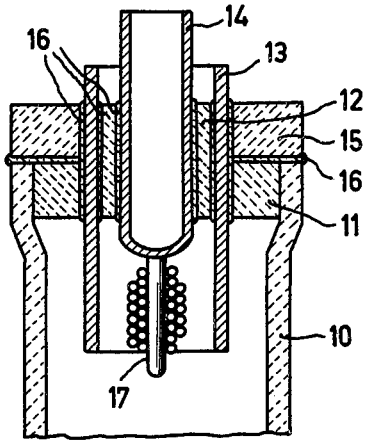
FIG. 2 and FIG. 3 are longitudinal sectional views through one end of a lamp vessel.

In FIG. 2, 10 denotes a part of the cylindrical wall of the lamp vessel 1 of FIG. 1. A part of the end seal of the lamp vessel is realized by means of a ceramic ring 11 which, like the other ceramic parts of the lamp vessel, consists of translucent, gas-tight aluminium oxide and is connected to the wall 10 by a shrinkage/sintering operation. Between the ring 11 and the ceramic ring 12 a niobium tube 13 is provided, while a niobium tube 14 is passed through the ring 12. A ceramic ring 15 is provided over the ceramic ring 11 and the wall 10 of the lamp vessel. The capillary spaces between ceramic parts and between ceramic and metal parts are sealed by means of a sealing material. A tungsten main electrode 17 is soldered to the niobium tube 14 by means of titanium.

Figure 3:
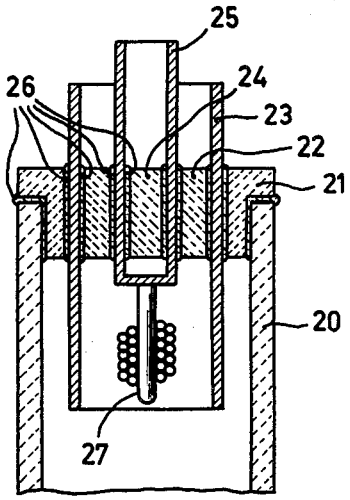

FIG. 3 shows a modified embodiment. A ceramic ring 21, which is partly pressed in the cylindrical lamp vessel and partly engages same, adjoins the cylindrical ceramic wall 20 of a lamp vessel connected thereto in a vacuum-tight manner by a sealing material 26. Between this ring and a second ceramic ring 22 a cylindrical tube 23 of molybdenum is disposed and is connected in a vacuum-tight manner to the two ceramic parts by sealing material 26. A cylindrical tube 25 of molybdenum with therein a ceramic cylinder 24 is incorporated in the ring 22. The capillary ducts between 22 and 25 and between 24 and 25 are filled with sealing material 26. A tungsten electrode 27 is welded to the tube 25.

Figure 4:
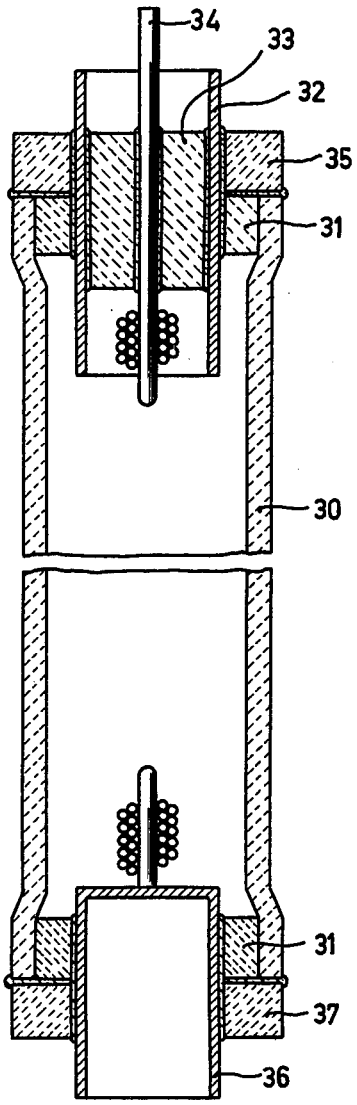
FIG. 4 is a longitudinal sectional view through a lamp vessel.

The construction of FIG. 4 was used in a 220 V/250 W high-pressure sodium discharge lamp. A cylindrical tube 30 of translucent gas-right aluminium oxide having an outside diameter of 8.6 mm and an inside diameter of 6.8 mms is sealed partly at either end by 3 mms thick rings 31 of translucent gas-tight aluminium oxide having an inside diameter of 4.1 mms. The connection of tube and rings was realized in a hydrogen atmosphere at 1850° C., in which as a result of shrinkage a rigid sintered joint between the parts was obtained. Before assembly the rings 31 had been fired to a higher temperature than the tube.

Provided at one end was a cylindrical niobium tube 32 having an outside diameter of 4 mms and a wall thickness of 200·μm together with a ceramic ring 33 of 8 mms length, outside diameter 3.5 mms, inside diameter 1.0 mm and with a niobium pin 34 of 0.9 mm thickness, to which a tungsten electrode having tungsten windings was welded. Also provided was a ceramic ring 35, thickness 3 mms, outside diameter approximately 9.2 mms, inside diameter 4.1 mms. Around the apertures to be sealed was provided sealing material: 44% by weight of $Al_2O_3$, 38% by weight of CaO, 9% by weight of BaO, 6% by weight of MgO, 2% by weight of $B_2O_3$ and 1% by weight of $SiO_2$. Heating was then carried out in vacuum up to approximately 1450° C.

The unilaterally closed tube was flushed with xenon, provided with 20 mg of sodium amalgam with a sodium content of 11% by weight and then sealed at the other end with a unilaterally closed niobium tube 36 of 4.0 mms outside diameter, 3.5 mms inside diameter, having a tungsten electrode, and with a ceramic ring 37, thickness 3 mms, outside diameter approximately 9.2 mms, inside diameter 4.1 mms. The heating said end so as to cause the sealing material to flow, was carried out in a xenon atmosphere of 40 Torr, while the other end of the lamp vessel was cooled. The tungsten main electrodes were provided with a barium-calcium tungsten thorium oxide emitter and had a mutual spacing of 52 mms. The tubular auxiliary electrode ended 1 mm below the top of the main electrode. The inside length of the lamp vessel was 65 mms.

During the whole life of the lamp no cracking occurred in the lamp vessel and the ignition of the lamp was rapid and reliable with a supply voltage of 220 V.

What is claimed is:

1. An electric discharge lamp which comprises a cylindrical ceramic lamp vessel provided with end seals which mainly consist of ceramic, each of said end seals including a cylindrical current leadthrough for a main electrode and, in at least one of the seals, a current leadthrough for an auxiliary electrode, said current leadthrough for the auxiliary electrode being a cylindrical tube which surrounds the current leadthrough for the main electrode concentrically and is separated therefrom by a ceramic ring, said cylindrical tube which forms the current leadthrough of the auxiliary electrode projecting at least 2 mms into said lamp vessel, said main electrode having a tip which extends axially further into said lamp vessel than said auxiliary electrode disposed in the same end of said lamp vessel, said cylindrical tube consisting of a material selected from the group consisting of tungsten, molybdenum, rhenium and alloys thereof.

* * * * *